US007127780B2

(12) United States Patent
Kimoto

(10) Patent No.: US 7,127,780 B2
(45) Date of Patent: Oct. 31, 2006

(54) BUTTON

(75) Inventor: Takashi Kimoto, Chiba (JP)

(73) Assignee: YKK Corporation, Tokyo (JP)

( * ) Notice: Subject to any disclaimer, the term of this patent is extended or adjusted under 35 U.S.C. 154(b) by 110 days.

(21) Appl. No.: 11/021,359

(22) Filed: Dec. 23, 2004

(65) Prior Publication Data

US 2005/0138780 A1 Jun. 30, 2005

(30) Foreign Application Priority Data

Dec. 25, 2003 (JP) ..... 2003-429180

(51) Int. Cl.
*A44B 1/18* (2006.01)
*A44B 1/08* (2006.01)
*A44B 1/00* (2006.01)

(52) U.S. Cl. ..... 24/90.1; 24/114.2

(58) Field of Classification Search ..... 24/114.9, 24/114.11, 114.2, 90.1; 2/78.4, 100, 265
See application file for complete search history.

(56) References Cited

U.S. PATENT DOCUMENTS 296,891 A * 4/1884 Thiery ..... 24/90.1
301,778 A * 7/1884 Ware ..... 24/90.1
697,812 A * 4/1902 Crabb ..... 24/114.11
2,170,234 A * 8/1939 Carley ..... 24/114.9
2,550,309 A * 4/1951 Stancombe ..... 24/90.1
2,637,082 A * 5/1953 Lowther et al. ..... 24/90.1

FOREIGN PATENT DOCUMENTS

| | | | |
|---|---|---|---|
| BE | 398564 | A | 9/1933 |
| DE | 630413 | C | 5/1936 |
| DE | 823958 | C | 12/1951 |
| DE | 9317495 | U1 | 1/1994 |
| JP | 60-199401 | A | 10/1985 |
| JP | 2001-161539 | | 6/2001 |
| JP | 2002-330802 | | 11/2002 |
| JP | 2003-180407 | | 7/2003 |

* cited by examiner

*Primary Examiner*—Robert J. Sandy
(74) *Attorney, Agent, or Firm*—Michael S. Leonard; Everest Intellectual Property Law Group

(57) ABSTRACT

A button has a button body (1) including an attachment to a fabric (6) and an extending portion (4) extending from the button body (1) in a predetermined direction. The button body (1) is turnably fixed to the fabric (6) by the attachment. The extending portion (4) has an insert portion (54) adapted to be inserted into a buttonhole, a guide (55) extending arcuately from the insert portion (54) toward the button body (1), the guide (55) guiding the button body (1) to the buttonhole when the button body (1) is turned.

14 Claims, 14 Drawing Sheets

BUTTON

BACKGROUND OF THE INVENTION

1. Field of the Invention

The present invention relates to a button used for jeans, etc. More specifically, a button being attached to a first fabric and capable of being fastened into or unfastened from a buttonhole formed on a second fabric.

2. Description of Related Art

Conventionally, a metal button has been used for jeans. When a denim etc. is used for the jeans, it is difficult to fasten and unfasten the button through a buttonhole due to its stiff texture.

To solve the disadvantage, a button swingable to a member attached to a fabric, i.e. a swing button has been developed. However, when the fabric is thick at an attachment position of the button and a turnback portion around the buttonhole, difficulty in fastening and unfastening the button cannot be completely solved.

With such background, some patent applications have been conventionally suggested relating to a buttoning tool facilitating fastening and unfastening operations through a buttonhole for a button attached to a stiff fabric like jeans (Reference 1: Japanese Patent Laid-Open publication No. 2001-161539 and Reference 2: Japanese Patent Laid-Open publication No. 2003-180407), and a button with an efficient shape to facilitate fastening and unfastening operations (Reference 3: Japanese Patent Laid-Open publication No. 2002-330802).

The former applications employ a buttoning tool having a grip portion and a button holding portion integrally molded therewith with a configuration in which the button holding portion of the buttoning tool is inserted into the buttonhole to hold the button at the button holding portion, and then the grip portion is pulled out so that the button held at the button holding portion is pulled out together and fastened into the buttonhole.

The latter application employs a configuration in which the back side of a button is formed to have a substantially V-shape bending toward the front side by sandwiching a thread fixing portion, and a tip end away from the thread fixing part is formed to be thinner than a base end close to the thread fixing part. In order to fasten the button, the thin tip end is first inserted into the buttonhole, and by pushing the tip end projected from the buttonhole from the front side toward the back side, the base end (the end close to the thread fixing part) pops up, so that the button is fastened into the buttonhole. In order to unfasten the button, by pushing the base end of the button to pass the base end through the buttonhole, the button is unfastened from the buttonhole.

In the applications disclosed in the References 1 and 2, since the buttoning tool is inserted into the buttonhole to hook the button for fastening the button, the operation is bothersome. Moreover, a user needs to carry the buttoning tool all the time in order to use it whenever necessary, thus it is not practical.

In the application disclosed in the Reference 3, since the tip end of the button is inserted into the buttonhole and the projected tip end portion is pushed to fasten the button into the buttonhole, the button is unexpectedly unfastened from the buttonhole easily due to misalignment of the fabric or the like. In order to unfasten the button, since the base end side of the button is passed through the buttonhole while keeping the base end side pushed, unfastening operation can be difficult depending on a width (size) of the base end.

SUMMARY OF THE INVENTION

An object of the present invention is to provide a button capable of being fastened into and unfastened from a buttonhole without carrying a tool like a buttoning tool.

According to an aspect of the present invention, in a button including a button body having an attachment to a first fabric and an extending portion extending from the button body in a predetermined direction, and being adapted to be fastened into and unfastened from a buttonhole formed on a second fabric, the button body is turnably fixed to the first fabric; and the extending portion has an insert portion adapted to be inserted into the buttonhole and a guide extending arcuately or linearly from the insert portion toward the button body, the guide guiding the button body to the buttonhole when the button body is turned.

The arc shape for the guide mentioned herein is not limited to the circular arc but may include shapes such as segment, ellipse, and the like.

In the present invention, in order to fasten the button, the insert portion of the extending portion is inserted into the buttonhole and the insert portion projected from the buttonhole is pinched to turn the button body. When the button body is turned, the guide extending arcuately or linearly from the insert portion toward the button body guides the button body to the buttonhole, and thus the button body can be smoothly guided to the buttonhole. By turning the button body by a predetermined angle, e.g. 180 degrees, the button comes out from the buttonhole, being fastened into the buttonhole.

In order to unfasten the button from the buttonhole, the extending portion is pinched to turn the button body so that the extending portion is located substantially on the extension of the buttonhole (on the extension of the buttonhole slit), and then the extending portion (insert portion) is lifted toward the direction away from the fabric. Then, the button is inclined with the attachment as a supporting point and a side opposite to the extending portion of the button body is slid into the buttonhole, and thus the button is unfastened from the buttonhole. By further pushing the button body, the button can be completely unfastened from the buttonhole.

Therefore, the button can be fastened only by inserting the insert portion into the buttonhole, pinching the insert portion projected from the buttonhole, and turning the button body. The button can be unfastened from the buttonhole only by lifting the extending portion in the direction away from the fabrics. Moreover, since a tool like a conventional buttoning tool does not have to be carried or used, the button can be easily fastened into or unfastened from the buttonhole.

In the button according to the present invention, it is preferable that a widening member for widening the buttonhole is provided on a side opposite to the extending portion of the button body with the attachment therebetween.

The widening member mentioned herein may have any shapes or configurations as long as it can widen the buttonhole slit. More specifically, any shapes can be employed as long as the button is gradually slid into the buttonhole to widen the buttonhole when the button body is inclined and pressed into the buttonhole, e.g. circular arc, triangle, and so on.

In the present invention, the widening member is provided on the side opposite to the extending portion of the button body with the attachment therebetween to widen the buttonhole. In order to unfasten the button, the widening member is pressed into the buttonhole by lifting the extending portion in a direction away from the first fabric, and is gradually moved into the buttonhole to further widen the buttonhole as the posture of the button body changes. Therefore, the button can be easily unfastened from the buttonhole.

In the button according to the present invention, it is preferable that the widening member has an inclined surface inclined toward a side opposite to the extending portion in accordance with the distance away from the first fabric fixed by the attachment.

In the present invention, in order to unfasten the button, the widening member gradually moves into the buttonhole to widen the buttonhole when the extending portion is lifted in the direction away from the first fabric, or as the posture of the button body is inclined. Therefore, the button can be smoothly unfastened from the buttonhole.

In the button according to the present invention, it is preferable that the guide continuously extends arcuately or linearly from the insert portion with the width thereof being gradually widened toward the button body.

In the arcuate guide, more specifically, it is preferable that two profile lines forming the profile of the guide have a shape like an arc curving in the same direction.

In the present invention, in order to fasten the button, the insert portion is inserted into the buttonhole and then the insert portion projected from the buttonhole is pinched to turn the button body. In this operation, since the guide continuously extends arcuately or linearly from the insert portion toward the button body with its width gradually widened, the button body moves to the buttonhole while being guided to the center of the buttonhole as the button body is turned, so that the button body can be easily fastened into the buttonhole.

In the button according to the present invention, it is preferable that the button body has a cover member and an attachment member turnably holding the cover member to the first fabric, the cover member being provided with the extending portion, the insert portion and the guide.

In the present invention, the cover member is provided with the extending portion, the insert portion and the guide. In other words, the cover member is provided with every component to realize each function described above, existing components excluding the cover member can be used and the button can be thinned.

In the button according to the present invention, it is preferable that the cover member has a metal connecting member turnably held by the attachment member, and a cover molded out of plastic with a part of the connecting member buried therein, the cover including the extending portion, the insert portion and the guide.

In the present invention, since the cover including the extending portion, the insert portion and the guide is molded out of plastic, especially the extending portion is easy to bend so that the button can be fastened even more easily.

In the button according to the present invention, it is preferable that the cover member has a metal connecting member turnably held by the attachment member and a die-cast cover engaged with a front side of the connecting member, the cover including the extending portion, the insert portion and the guide.

In the present invention, the cover including the extending portion, the insert portion and the guide is formed by die-casting. Since the die-cast cover can also function as a die caulking and deforming a fixture (tack) when the fixture (tack) is caulked from the side opposite to the attachment member with the fabric sandwiched therebetween, it can be easily attached to the fabric.

In the button according to the present invention, it is preferable that the cover member has a connecting member turnably held by the attachment member and a cover provided on a front side of the connecting member, the cover including the extending portion, the insert portion and the guide, the connecting member and the cover being integrally molded by metal plate press working.

In the present invention, since the cover including the extending portion, the insert portion and the guide is integrally molded with the connecting member by metal plate press working, it can be processed easily with low cost.

In the button according to the present invention, it is preferable that a cover member has a plastic connecting member turnably held by the attachment member and a cover molded integrally on a front side of the connecting member, the cover including the extending portion, the insert portion and the guide.

According to the present invention, since the cover including the extending portion, the insert portion and the guide is molded out of plastic, especially the extending portion is easy to bend so that the button can be fastened even more easily. Furthermore, the cover and the connector are integrally molded out of plastic, manufacturing and assembly processes can be reduced.

In the button according to the present invention, it is preferable that the attachment member has a plurality of holes penetrating front and back sides of the button body.

In the present invention, the button can be fixed directly to the fabric by using the plurality of holes formed on the button and penetrating front and back sides thereof. With the configuration, since the button body needs to be turnably fixed to the fabric, the thread requires to have some looseness so that a clearance is provided between the fabric and the button body.

DETAILED DESCRIPTION OF PREFERRED EMBODIMENT(S)

Embodiments of the present invention will be described below with reference to the attached drawings.

[First Embodiment]

Figure 1A:
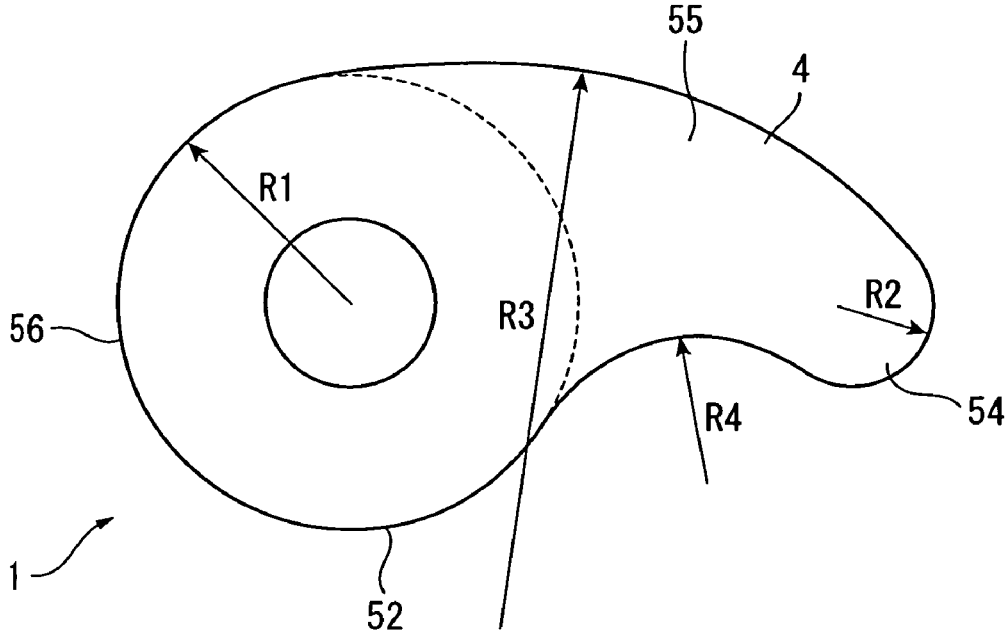
FIGS. 1A and 1B are a plan view and a sectional view showing a button according to a first embodiment of the present invention.
Figure 1B:
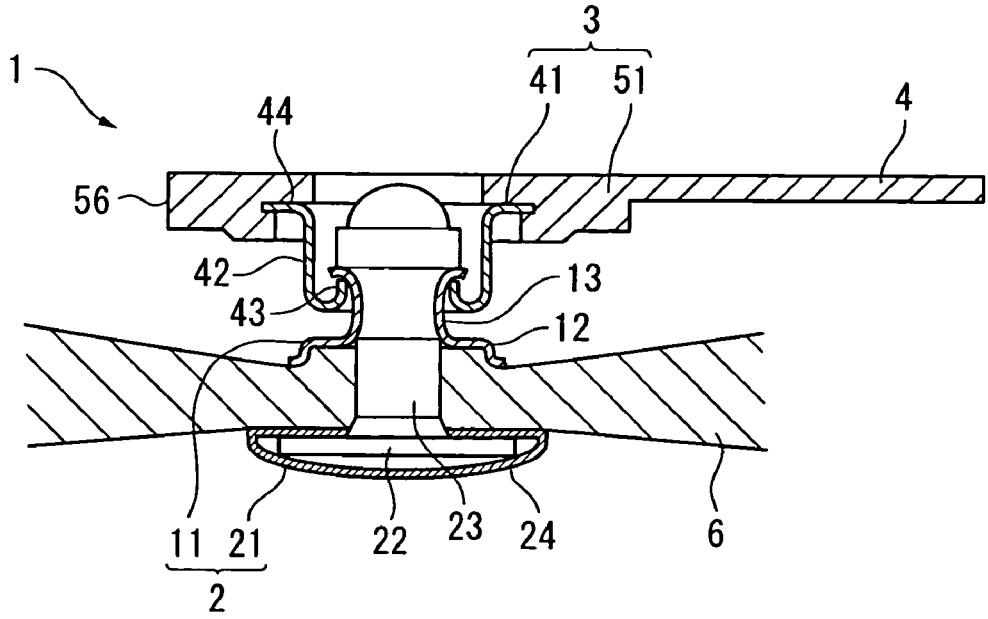

FIGS. 1A and 1B show a first embodiment with a button of the present invention applied to the button for jeans, and FIG. 1A is a plan view while FIG. 1B is a sectional view. As shown in FIGS. 1A and 1B, the button of the first embodiment has a button body 1 including an attachment to a first fabric 6 and an extending portion 4 extending from the button body 1 in a predetermined direction, and is so formed that the button can be fastened into and unfastened from a buttonhole provided to a second fabric (not shown).

The button body 1 includes an attachment member 2 forming an attachment to the first fabric 6, and a cover member 3 turnably and swingably held on a front side of the attachment member 2. In other words, the cover member 3 is turnably and swingably held to the first fabric 6 through the attachment member 2.

The attachment member 2 has a front side fixing tube 11 applied to the front side of the first fabric 6, and a back side fixture 21 penetrating the first fabric 6 and the front side fixing tube 11 from the back side of the first fabric 6 for being caulked.

Figure 2:
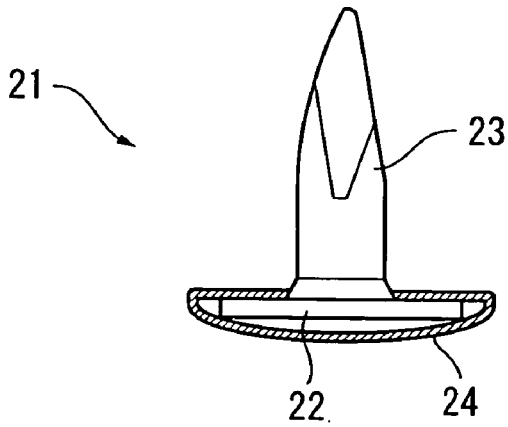
FIG. 2 is an illustration showing a back side fixture used in the aforesaid embodiment.

The front side fixing tube 11 is made of metal and has a ring portion 12 applied to the front side of the first fabric 6, and a cylindrical tube portion 13 upright from the center of the ring portion with its tip end slightly widened toward outside. The back side fixture 21, as shown in FIG. 2, has a metal fixture body 23 shaped like a rivet with a flange-like head 22, and a decorative cover 24 covering the head 22 of the fixture body 23.

Figure 3:
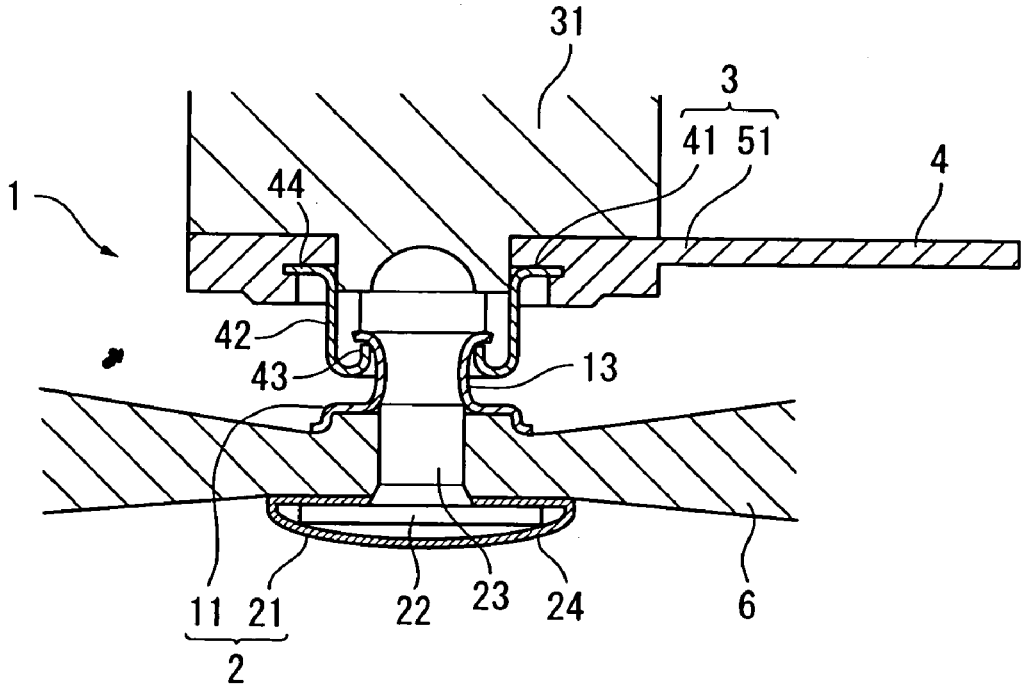
FIG. 3 is an illustration showing a state in which the button is fixed to a fabric in the aforesaid embodiment.

In order to fix the button body 1 to the first fabric 6, as shown in FIG. 3, the cover member 3 is set to an attachment die 31, and the back side fixture 21 penetrating the first fabric 6 from the back side thereof is inserted into the front side fixing tube 11 for caulking. Then, a tip end of the back side fixture 21 is deformed into the shape of the attachment die 31 (hemispheric shape), and thereby the button body 1 can be turnably and swingably fixed to the first fabric 6.

The cover member 3 has a metal connector 41 as a connecting member that is turnably held to the front side fixing tube 11 of the attachment member 2, and a cover 51 molded out of plastic with a part of the connector 41 buried therein.

The connector 41 has a tube 42 with a diameter larger than the front side fixing tube 11, an engaging portion 43 bended inwardly toward an end of the tube 42 to turnably and swingably engage with a tip end of the tube portion 13, and a flange 44 extending toward the other side of the tube 42 and buried in the cover 51

The cover 51 has a body cover portion 52 forming the button body 1, the extending portion 4 extending from the body cover portion 52 in a predetermined direction (a right hand in FIG. 1A), a widening member 56 formed on a side opposite of the extending portion 4 with the attachment member 2 (attachment) therebetween to widen a buttonhole. The body cover portion 52 and the extending portion 4 have a shape like a curved ellipse in plan view.

The body cover portion 52 has a substantially disc shape with a hole at the substantially center thereof. The radius R1 of the body cover portion 52 is set to be smaller than half of a length of the buttonhole slit formed on the second fabric for the button to be fastened and unfastened, i.e., a sufficient length for the body cover portion 52 to pass through the buttonhole.

The extending portion 4 has an insert portion 54 adapted to be inserted into the buttonhole, a guide 55 extending arcuately from the insert portion 54 toward the body cover portion 52, the guide 55 guiding the body cover portion 52 to the buttonhole when the button body 1 is turned.

The insert portion 54 is formed so that its tip end has a shape like a circular arc in plan view. The arc radius R2 of the insert portion 54 is set to be smaller than the radius R1 of the body cover portion 52, more specifically, approximately one third of the radius R1. The radius R2 may also be approximately one sixth to four sixth of the radius R1.

The guide 55 continuously extends arcuately from the insert portion 54 toward the body cover portion 52 (button body) with its width gradually widened. That is, two profile lines forming a profile of the guide 55 have a shape like an arc (circular arc) curving in the same direction, and the distance lying between the two profile lines are gradually widened. More specifically, the circular arc radius R3 of a first profile line forming the guide 55 is set to be 2.5 to 3 times (more preferably, approximately 2.7 times) as large as the radius R1 of the body cover portion 52, and the circular arc radius R4 of a second profile line is set to be 0.7 to 0.9 times (more preferably, approximately 0.7 times) as large as the radius R1 of the body cover portion 52. Here, a length of the guide 55 is set so that a length between a tip end of the insert portion 54 and the outermost periphery of the body cover portion 52 is substantially identical with a length of the buttonhole slit or longer.

The widening member 56 is formed so that a side opposite to the extending portion 4 with the attachment member 2 (attachment) therebetween is most projected toward outside. More specifically, the widening member is so formed that the side opposite to the extending portion 4 with the attachment member 2 therebetween most projects toward outside on a line connecting the center of the body cover portion 52 and the center of the insert portion 54, here, the widening member is formed with the body cover portion 52 shaped like a circular arc (arc).

Figure 4:
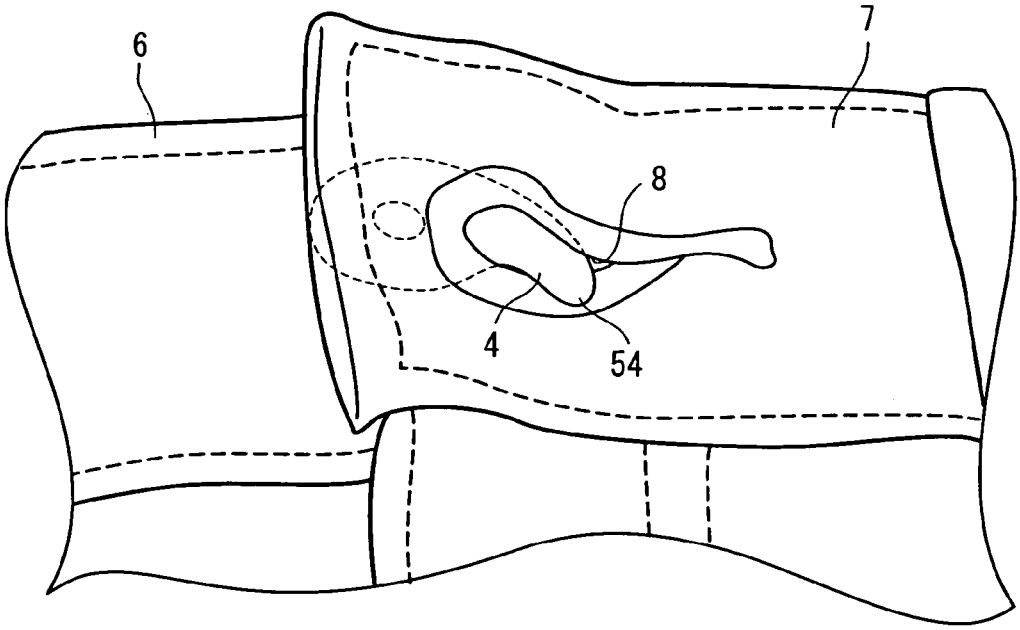
FIG. 4 is an illustration showing a state in which the button is fastened into a buttonhole (first step) in the aforesaid embodiment.
Figure 5:
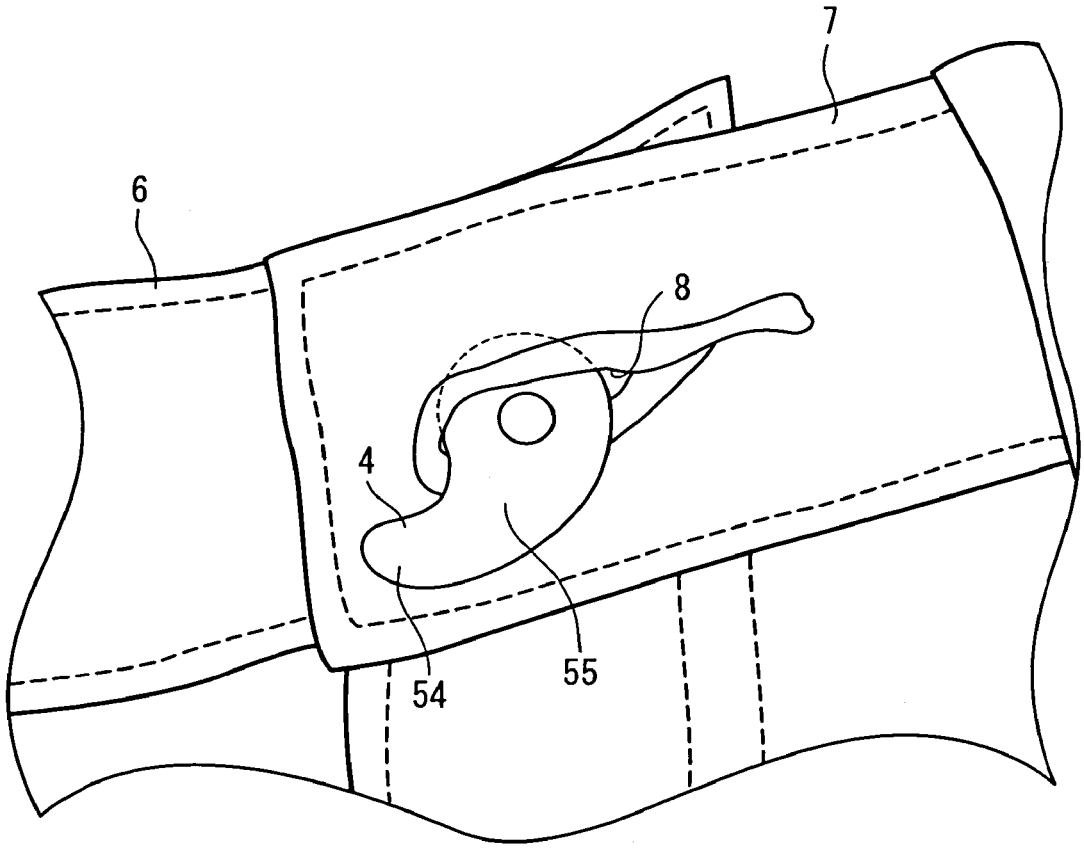
FIG. 5 is an illustration showing a state in which the button is fastened into the buttonhole (second step) in the aforesaid embodiment.
Figure 6:
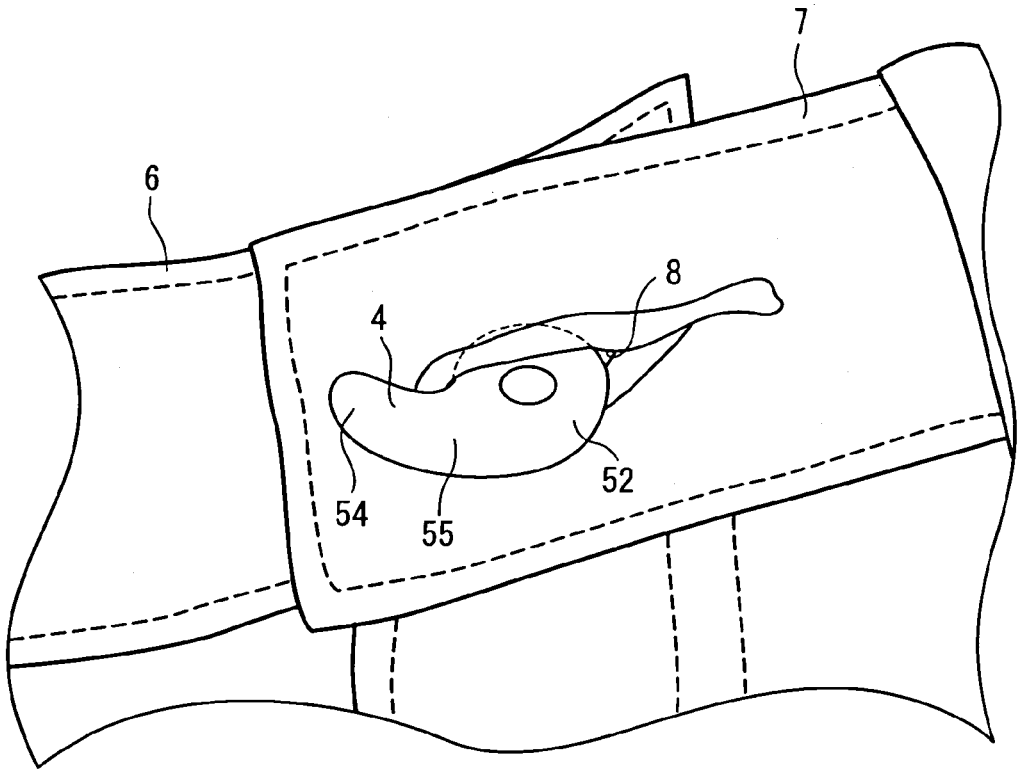
FIG. 6 is an illustration showing a state in which the button is fastened into the buttonhole (third step) in the aforesaid embodiment.
Figure 7:
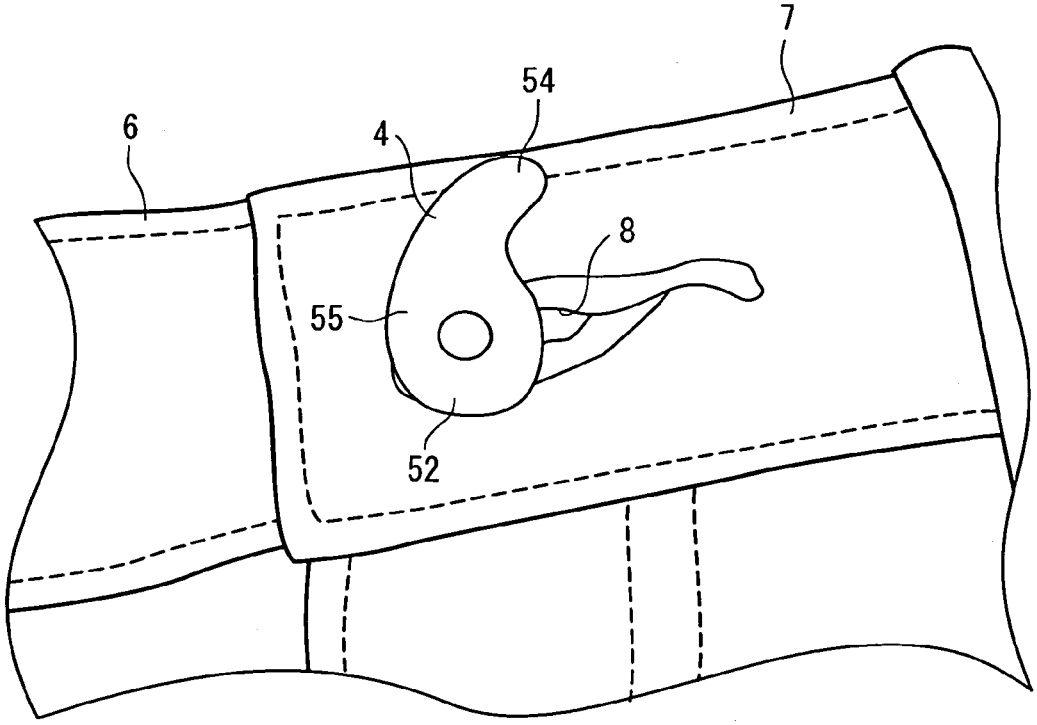
FIG. 7 is an illustration showing a state in which the button is fastened into a buttonhole (fourth step) in the aforesaid embodiment.
Figure 8:
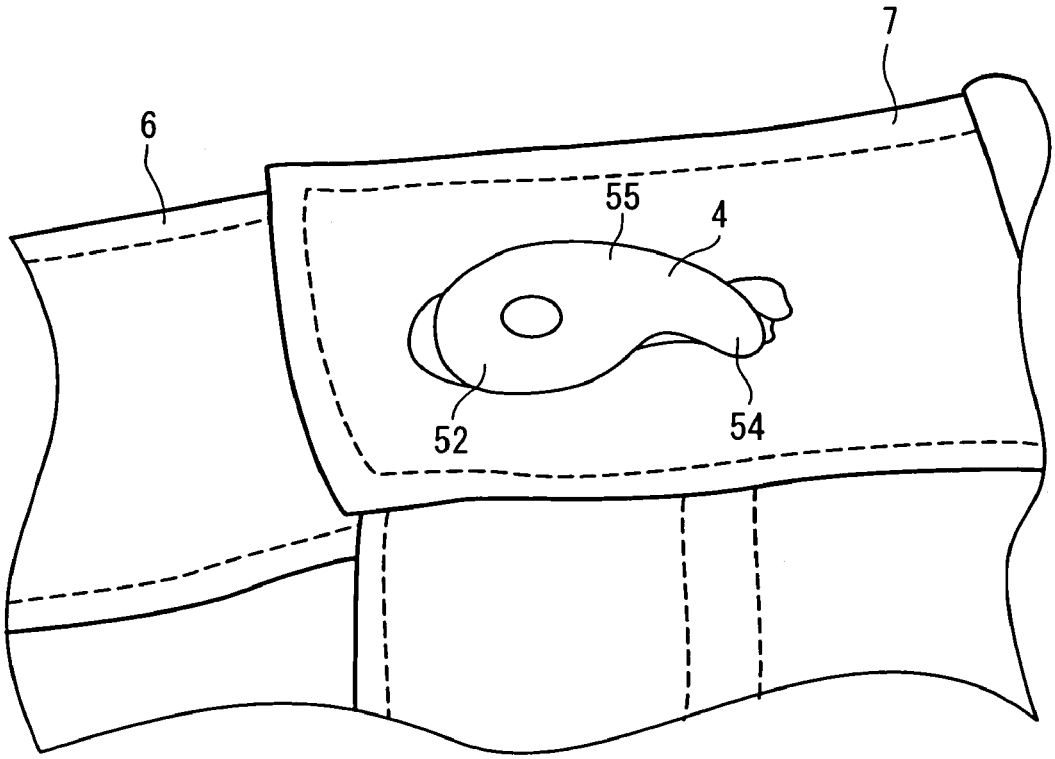
FIG. 8 is an illustration showing a state in which the button is fastened into the buttonhole (fifth step) in the aforesaid embodiment.

In the above configuration, in order to fasten the button, the insert portion 54 of the extending portion 4 is inserted into a buttonhole 8 formed on the second fabric 7 as shown in FIG. 4, and then the insert portion 54 projected from the buttonhole 8 is pinched to turn the button body 1. When the button body 1 is turned, the guide 55 extending arcuately from the insert portion 54 toward the button body 1 guides the button body 1 to the buttonhole 8, and thus the button body 1 can be smoothly guided to the buttonhole 8. When the button body 1 is turned at a predetermined angle, e.g. 180 degrees, the button body 1 is substantially comes out from the buttonhole 8 as shown in FIG. 6. From this state, the button body 1 is further turned by 180 degrees to align the extending portion 4 with the slit of the buttonhole 8 as shown in FIGS. 7 and 8. The button is thereby fastened into the buttonhole 8.

Figure 9:
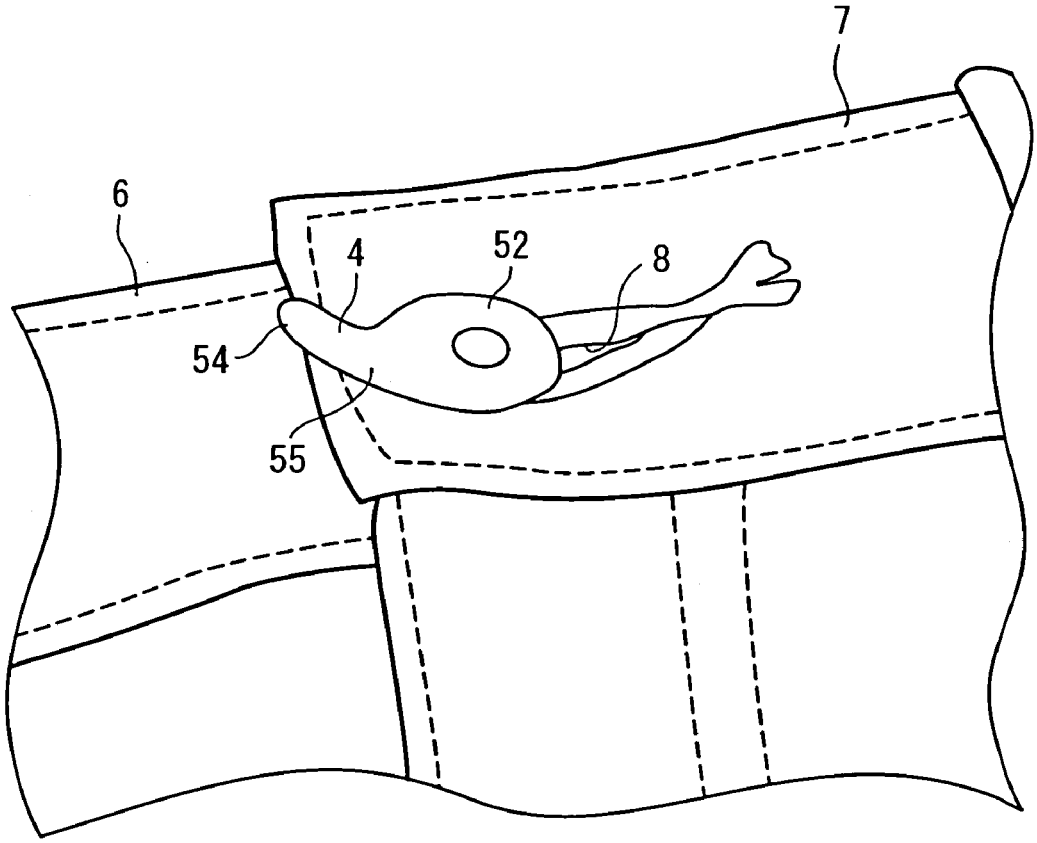
FIG. 9 is an illustration showing a state in which the button is unfastened from the buttonhole (first step) in the aforesaid embodiment.
Figure 10:
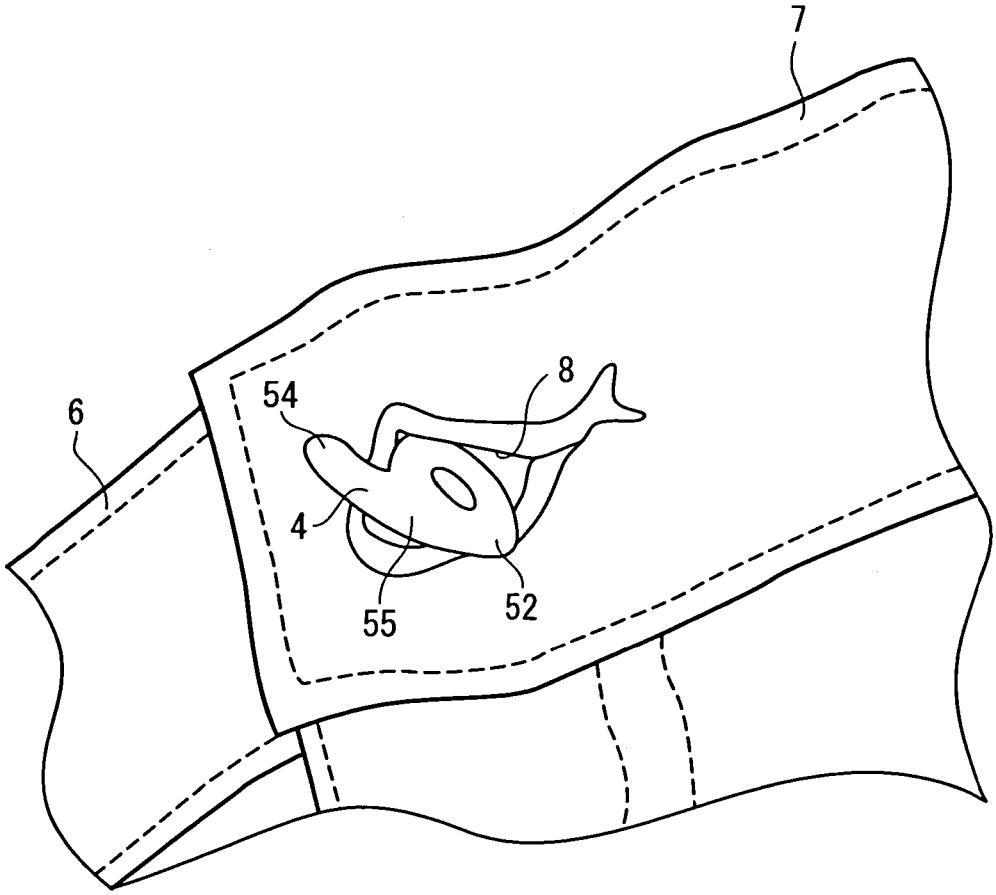
FIG. 10 is an illustration showing a state in which the button is unfastened from the buttonhole (second step) in the aforesaid embodiment.
Figure 11:
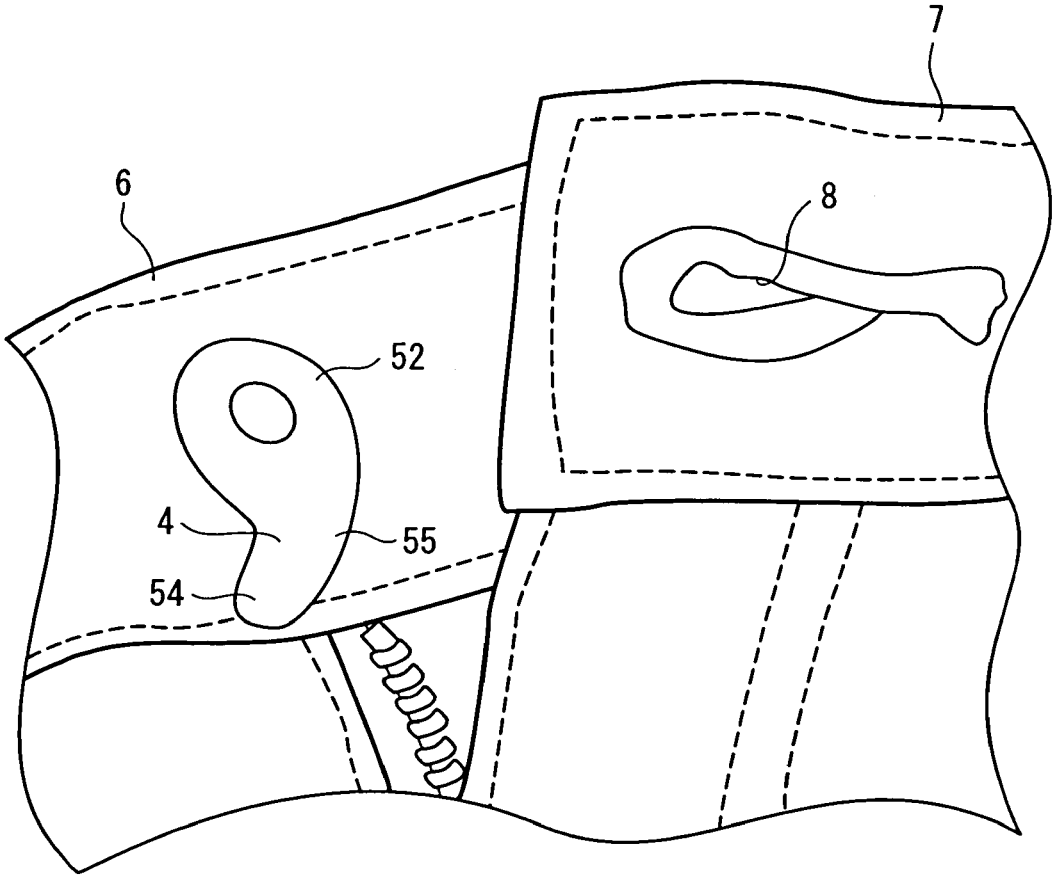
FIG. 11 is an illustration showing a state in which the button is unfastened from a buttonhole (third step) in the aforesaid embodiment.

On the other hand, in order to unfasten the button from the buttonhole 8, the button body 1 is turned to locate the extending portion 4 almost on the extension of the slit of the buttonhole 8 as shown in FIG. 9, and the extending portion 4 is lifted toward the direction away from the fabrics 6 and 7 as shown in FIG. 10. Since the body cover portion 52 (button body 1) is slid into the buttonhole 8, the button is thus unfastened from the buttonhole 8 (refer to FIG. 11).

With the button according to the present embodiment, the following advantages can be obtained.

(1) The button can be fastened by inserting the insert portion 54 into the buttonhole 8, pinching the insert portion 54 projected from the buttonhole 8, and turning the button body 1. The button can be unfastened from the buttonhole 8 only by lifting the extending portion 4 toward the direction away from the fabrics 6 and 7. Moreover, since a tool like a conventional buttoning tool does not have to be carried or used, the button can be easily fastened into or unfastened from the buttonhole 8.

(2) In order to fasten the button, the insert portion 54 is inserted into the buttonhole 8 and the insert portion 54 projected from the buttonhole 8 is pinched to turn the button body 1. Since the guide 55 continuously extends arcuately from the insert portion 54 toward the body cover portion 52 (button body) with its width gradually widened, the body cover portion 52 (button body) moves to the buttonhole 8 while being guided to the center of the buttonhole 8 as the body cover portion 52 (button body) is turned, so that the body cover portion 52 can be easily fastened into the buttonhole 8.

(3) Since the length of the guide 55 is so set that the length between a tip end of the insert portion 54 and the outermost periphery of the body cover portion 52 is substantially identical with a length of the slit of the buttonhole 8 or longer, the button is not unexpectedly unfastened from the buttonhole 8 so easily with a state being fastened into the buttonhole 8.

(4) The widening member 56 is provided on the side opposite to the extending portion 4 of the cover 51 with the attachment member 2 therebetween to widen the buttonhole. In order to unfasten the button, the widening member 56 is pressed into the buttonhole 8 by lifting the extending portion 4 in a direction away from the first fabric 6. Then, since the widening member 56 gradually moves into the buttonhole 8 to further widen the buttonhole 8 as the position of the cover 51 changes, the button can be easily unfastened from the buttonhole 8.

(5) The button body 1 has the cover member 3 and the attachment member 2 turnably holding the cover member 3 to the first fabric 6, and the cover member is provided with the extending portion 4, the insert portion 54, the guide 55 and the widening member 56. In short, since the button body 1 is provided with every component to realize each function described above, existing components excluding the cover member 3 can be used and the button can be thinned.

(6) The cover member 3 is formed with the metal connector 41 and the cover 51 molded with a part of the connector 41 buried therein, and the cover 51 including the extending portion 4, the insert portion 54, the guide 55, and the widening member 56 is molded out of plastic. Therefore, especially the extending portion 4 is easy to bend so that the button can be fastened even more easily.

[Second Embodiment]

Figure 12:
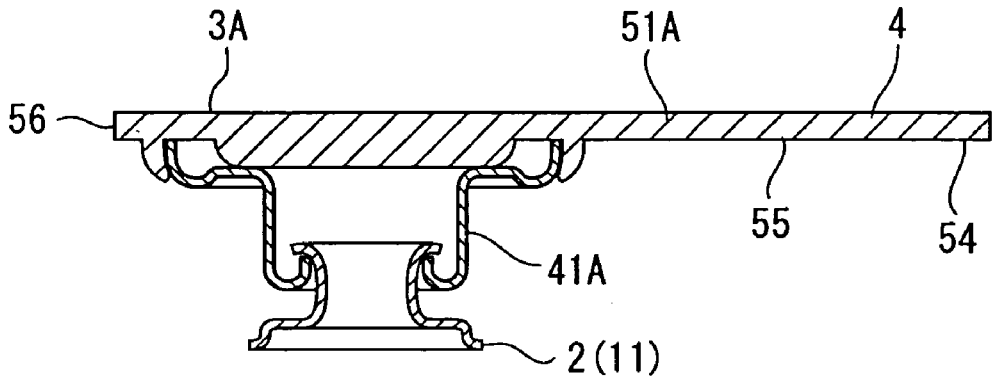
FIG. 12 is a sectional view showing a button according to a second embodiment of the present invention.

FIG. 12 shows a button according to a second embodiment of the present invention. The button in the second embodiment differs from the button in the first embodiment only in its cover member.

The cover member 3A of the present embodiment has a metal connector 41A as a connecting member that is turnably held by the attachment member 2 (the front side fixing tube 11), and a die-cast cover 51A engaged with the front side of the connector 41A.

According to the present embodiment, the cover 51A including the extending portion 4, the insert portion 54, the guide 55 and the widening member 56 is formed by die-casting. Since the die-cast cover 51A can also function as a die caulking and deforming the back side fixture when the back side fixture is caulked from the opposite side of the attachment member 2 with a fabric sandwiched therebetween, it can be easily attached to a fabric.

[Third Embodiment]

Figure 13:
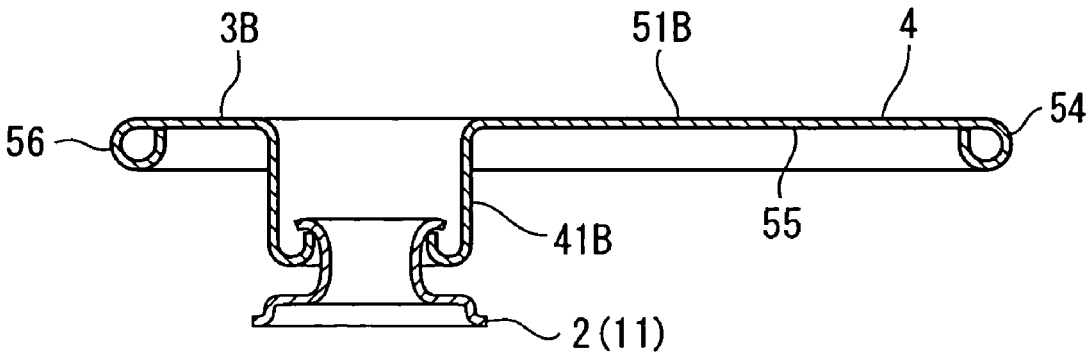
FIG. 13 is a sectional view showing a button according to a third embodiment of the present invention.

FIG. 13 shows a button according to a third embodiment of the present invention. The button in the third embodiment differs from the button in its first embodiment only in the cover member.

The cover member 3B has a connector 41B as a connecting member turnably held by the attachment member 2 (front side fixing tube 11), and a cover 51B provided on the front side of the connector 41B, and the connector 41B and the cover 51B are integrally molded by metal plate press working. The connector 41B and the cover 51B are processed to have the edge rolled up toward inside (for safety).

According to the present embodiment, since the cover 51B including the extending portion 4, the insert portion 54, the guide 55 and the widening member 56 is integrally molded with the connector 41B by metal plate press working, it can be processed easily with low cost.

[Fourth Embodiment]

Figure 14:
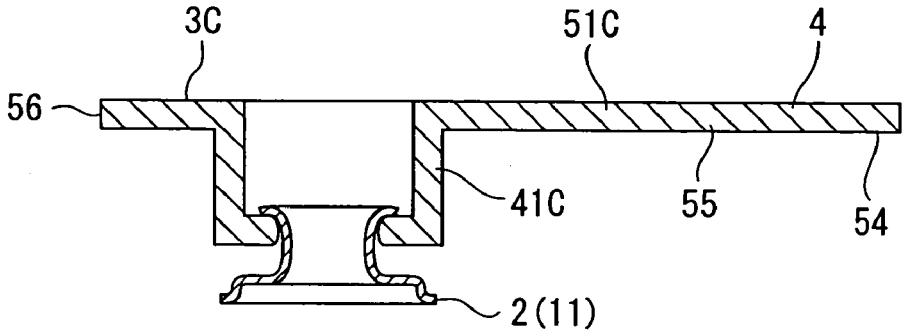
FIG. 14 is a sectional view showing a button according to a fourth embodiment of the present invention.

FIG. 14 shows a button according to a fourth embodiment of the present invention. The button in the fourth embodiment differs from the button in the first embodiment only in the cover member.

The cover member 3C of the present embodiment has a plastic connector 41C as a connecting member that is turnably held by the attachment member 2 (the front side fixing tube 11), and a plastic cover 51C molded integrally on the front side of the connector 41C.

According to the present embodiment, the cover 51C including the extending portion 4, the insert portion 54, the guide 55 and the widening member 56 is molded out of plastic. Therefore, especially the extending portion 4 is easy to bend so that the button can be fastened more easily. Moreover, the connector 41C is integrally molded with the cover 51C, manufacturing and assembly processes can be reduced.

Figure 15:
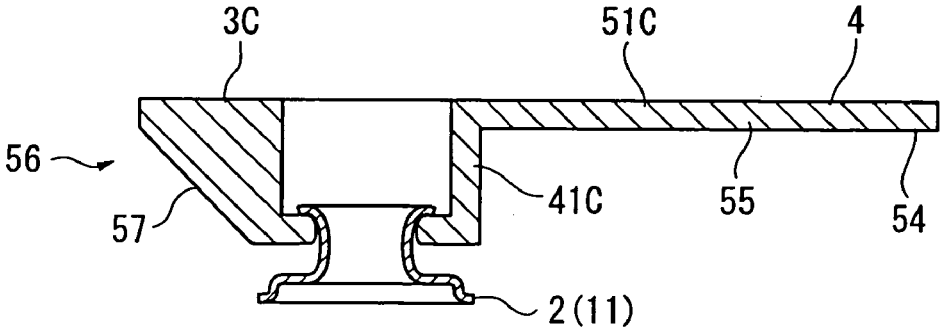
FIG. 15 is a sectional view showing modification of the button according to the fourth embodiment of the present invention.

In the fourth embodiment, as shown in FIG. 15, the cover member 3C is provided with the widening member 56 different from ones in the above described embodiments is formed on the side opposite to the extending portion 4 with the attachment member 2 (attachment) therebetween. The widening member 56 has an inclined surface 57 gradually inclining toward the side opposite to the extending portion 4 in accordance with the distance away from the first fabric 6 fixed by the attachment member 2 (attachment).

In order to unfasten the button, when the extending portion 4 is lifted in the direction away from the first fabric 6, i.e. as the posture of the button body 1 is inclined, the inclined surface 57 of the widening member 56 gradually moves into the buttonhole 8 to further widen the buttonhole 8. Therefore, the button can be unfastened from the buttonhole

[Fifth Embodiment]

Figure 16A:
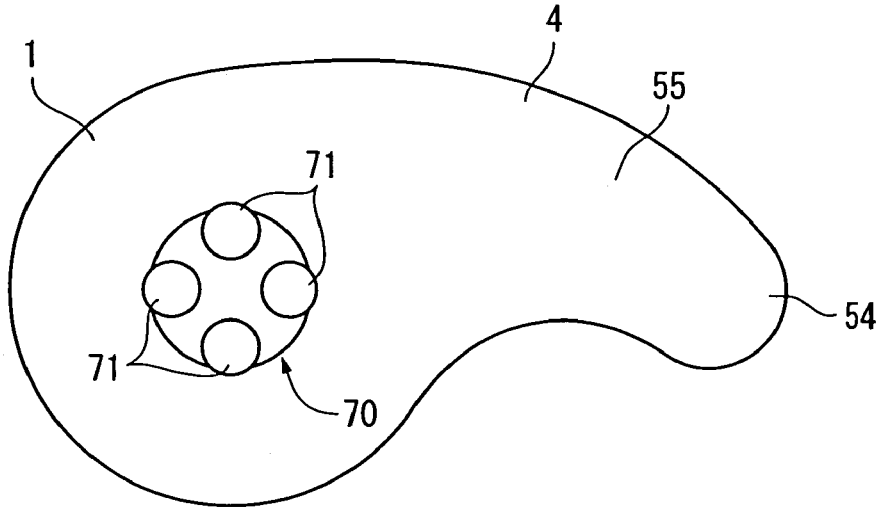
FIGS. 16A and 16B are a plan view and a sectional view showing a button according to a fifth embodiment of the present invention.
Figure 16B:
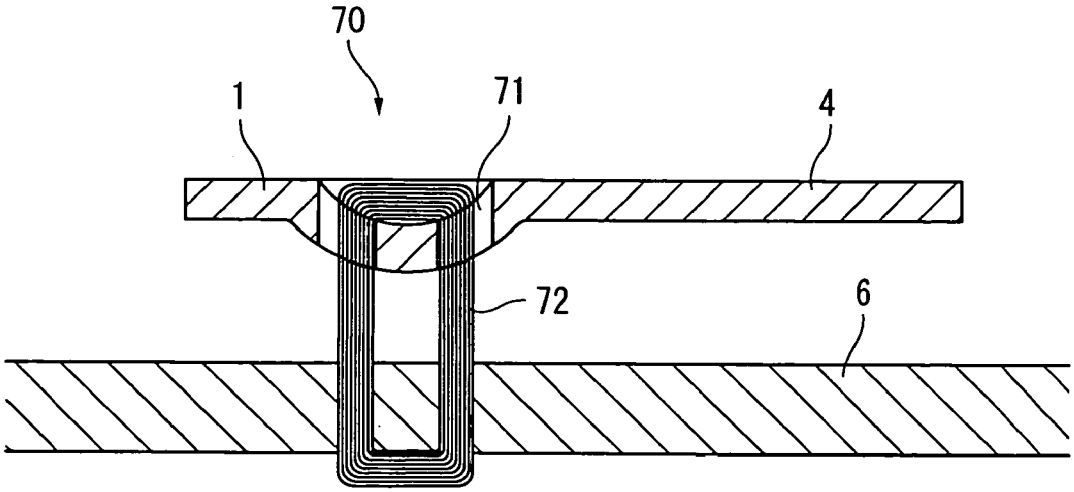

FIGS. 16A and 16B show a button according to a fifth embodiment of the present invention.

The button of the present embodiment has the button body 1 including a metal or plastic attachment 70 to the fabric and the extending portion 4 extending from the button body 1 in a predetermined direction, and the button is shaped like a curved ellipse in plan view.

The extending portion 4 has the insert portion 54 adapted to be inserted into the buttonhole, the guide 55 extending arcuately from the insert portion 54 toward the button body 1 and the guide 55 guiding the button body 1 to the buttonhole when the button body is turned.

The attachment 70 is provided with a plurality of (four) holes 71 formed at the center of the button body 1 and penetrating front and back sides thereof, and the button body 1 is turnably fixed to the first fabric 6 by thread 72 connecting the four holes 71 and the first fabric 6.

According to the present embodiment, the button can be fixed directly to the first fabric 6 by the thread 72 by using the plurality of holes 71 formed on the button and penetrating front and back sides thereof. With the configuration, since the button body 1 needs to be turnably fixed to the first fabric 6, the thread 72 requires to have some looseness so that a clearance is provided between the first fabric 6 and the button body 1.

[Sixth Embodiment]

Figure 17A:
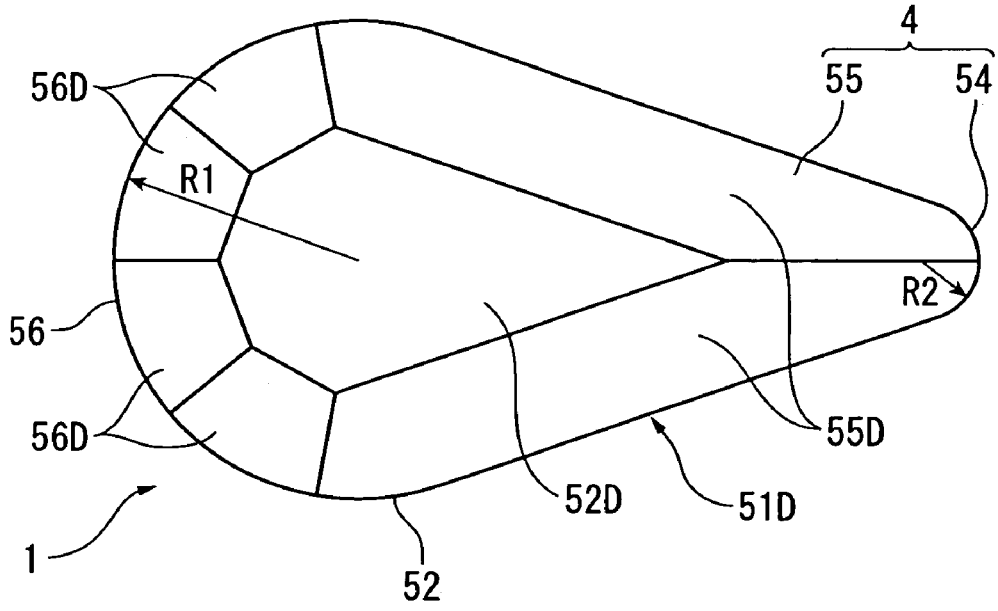
FIGS. 17A and 17B are a plan view and a sectional view showing a button according to a sixth embodiment of the present invention.
Figure 17B:
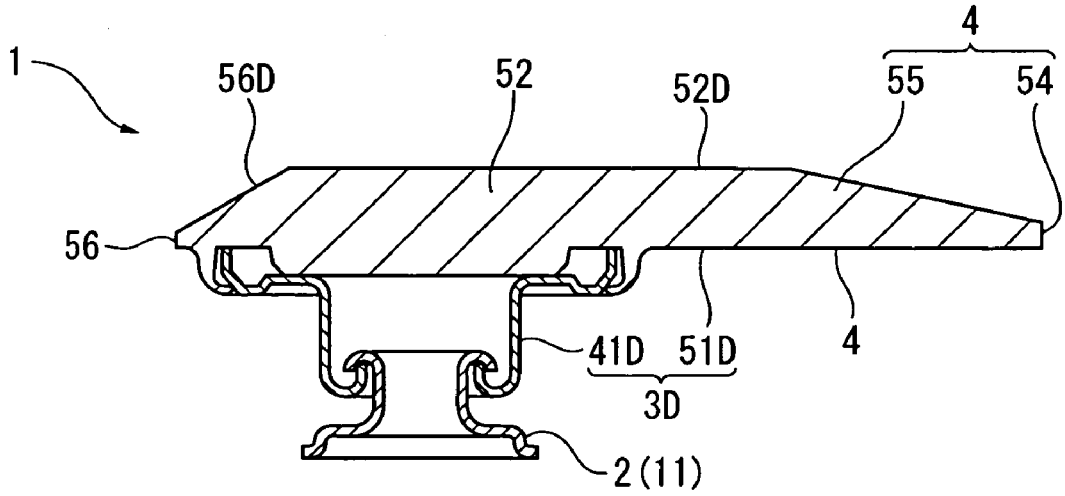

FIGS. 17A and 17B show a button according to a sixth embodiment of the present invention. The button in the sixth embodiment differs from the button in its first embodiment only in the cover member.

The cover member 3D of the present embodiment has the attachment member 2, a connector 41D and a die-cast cover 51D. The cover 51D is provided with the body cover portion 52, the guide 55, the insert portion 54 and the widening member 56. The guide 55 and the insert portion 54 form the extending portion 4.

In the present embodiment, both side edges of the guide 55 are linearly formed. The cover 51D is so formed that the center part is bulged with a top surface 52D having a flat surface, which is surrounded by inclined surfaces 55D and 56D. Each of the inclined surfaces 55D is a flat surface formed along each of the side edges of the guide 55. The inclined surfaces 56D are located on a substantially semicircle circumference of the widening member 56. Due to the inclined surfaces 55D and 56D, respective thickness of the guide 55, the insert portion 54 and the widening member 56 are gradually increased from the respective edges toward the inner sides.

According to the present embodiment, the extending portion 4 is formed into a shape having a thin tip end (insert portion 54) and the thickness thereof is gradually increased toward the button body (the body cover 52). Therefore, in addition to the advantage (2) in the first embodiment, the present embodiment provides an advantage of smoothness in inserting the button into the buttonhole.

The present invention is not limited to the above-described embodiment, but includes improvements and modifications as long as an object of the present invention can be achieved.

For example, a shape of the tip end of the insert portion 54 is not limited to a circular arc, but may also be a triangle, trapezoid, etc. as long as it can be inserted into the buttonhole relatively easily.

A shape of the guide 55 is not limited to the one with both profile lines shaped like a circular arc but may also be the one with only one of the profile lines shaped like a circular arc. In other words, in the above-described embodiment, the circular arc of the radius R3 may be a straight line contacting with outer circumference of the insert portion 54 and the outer circumference of the body cover portion 52, or the circular arc of the radius R4 may be a straight line contacting with the outer circumference of the insert portion 54 and the outer circumference of the body cover portion 52

The widening member 56 shown in FIG. 15 can also be applied to the first to third embodiments and the fifth embodiment in addition to the fourth embodiment.

The attachment to the first fabric 6 is not limited to the configurations of the attachment member 2 and the hole 71 described in the above embodiments but may be any configurations as long as the button body 1 is turnable to the first fabric 6. Preferably, the turning angle of the button body 1 is at least 270 degrees or greater.

In the sixth embodiment, the cover 51D is so formed that the center part is bulged and the surfaces thereof are constituted with the top surface 52D and the plurality of inclined surfaces 55D and 56D, each of the surfaces being flat. However, any of or all of the top surface 52D and the plurality inclined surfaces 55D and 56D may have curved concave or convex surface without limiting to flat surface. The inclined surfaces 56D around the top surface 52D may be formed with one circular conical surface continuously surrounding the top surface 52D, and the inclined surfaces 55D may also be formed with one continuous curved surface. The top surface 52D may be constituted with a plurality of surfaces. Thus, sectioning of each surfaces may appropriately selected in accordance with an application. The cover 51D is not necessarily constituted with a plurality of surfaces, and it may be formed with one continuous curved surface. Further, the center part of the cover 51D is not necessarily bulged, and the entire surface may be formed with one continuous flat surface.

The priority application No. JP2003-429180 upon which this patent application is based is hereby incorporated by reference.

What is claimed is:

1. A button comprising: a button body having an attachment to a first fabric; and an extending portion extending from the button body in a predetermined direction, the button being adapted to be fastened into and unfastened from a buttonhole formed on a second fabric, wherein the button body is turnably fixed to the first fabric, and wherein the extending portion has an insert portion adapted to be inserted into the buttonhole and a guide extending arcuately from the insert portion toward the button body, the guide guiding the button body to the buttonhole when the button body is turned.

2. The button according to claim 1, wherein a widening member for widening the buttonhole is provided on a side opposite to the extending portion of the button body with the attachment therebetween.

3. The button according to claim 2, wherein the widening member has an inclined surface inclined toward a side opposite to the extending portion in accordance with the distance away from the first fabric fixed by the attachment.

4. The button according to claim 1, wherein the guide continuously extends arcuately from the insert portion with the width thereof being gradually widened toward the button body.

5. The button according to claim 4, wherein two profile lines forming the profile of the guide are arced curving in the same direction.

6. The button according to claim 1, wherein the button body has a cover member and an attachment member turnably holding the cover member to the first fabric, and wherein the cover member is provided with the extending portion, the insert portion and the guide.

7. The button according to claim 6, wherein the cover member has a metal connecting member turnably held by the attachment member and a cover molded out of plastic with a part of the connecting member buried therein, the cover including the extending portion, the insert portion and the guide.

8. The button according to claim 6, wherein the cover member has a metal connecting member turnably held by the attachment member and a die-cast cover engaged with a front side of the connecting member, the cover including the extending portion, the insert portion and the guide.

9. The button according to claim 6, wherein the cover member has a connecting member turnably held by the attachment member and a cover provided on a front side of the connecting member, the cover including the extending portion, the insert portion and the guide, and the connecting member and the cover being integrally molded by metal plate press working.

10. The button according to claim 6 wherein the cover member has a plastic connecting member turnably held by the attachment member and a cover molded integrally on a front side of the connecting member, the cover including the extending portion, the insert portion and the guide.

11. The button according to claim 1, wherein the attachment member has a plurality of holes penetrating front and back sides of the button body.

12. A button comprising: a button body having an attachment to a first fabric; and an extending portion extending from the button body in a predetermined direction, the button being adapted to be fastened into and unfastened from a buttonhole formed on a second fabric, wherein the button body is turnably fixed to the first fabric, and wherein the extending portion has an insert portion adapted to be inserted into the buttonhole and a guide extending from the insert portion toward the button body, the guide guiding the button body to the buttonhole when the button body is turned.

13. The button according to claim 12, wherein the guide is continuously and linearly extending from the insert portion with the width thereof being gradually widened toward the button body.

14. The button according to claim 12, wherein the button body has a cover member and an attachment member turnably holding the cover member to the first fabric, and wherein the cover member is provided with the extending portion, the insert portion and the guide.

* * * * *